United States Patent [19]

Linstromberg et al.

[11] Patent Number: 4,942,979

[45] Date of Patent: Jul. 24, 1990

[54] ICE DISPENSING APPARATUS

[75] Inventors: William J. Linstromberg, Lincoln Township, Berrien County; Donald E. Janke, Benton Township, Berrien County; Chris A. Scriber, St. Joseph, all of Mich.

[73] Assignee: Whirlpool Corporation, Benton Harbor, Mich.

[21] Appl. No.: 747,890

[22] Filed: Jun. 24, 1985

Related U.S. Application Data

[63] Continuation-in-part of Ser. No. 500,324, Jun. 2, 1983, abandoned.

[51] Int. Cl.[5] ..... G07F 11/36

[52] U.S. Cl. ..... 221/75; 222/240; 222/643; 62/340

[58] Field of Search ..... 221/75, 150 R, 203; 62/344; 222/236–237, 239–241, 413, 410, 14, 21, 638–639, 642–643; 141/102, 193–195, 351, 360–361

[56] References Cited

U.S. PATENT DOCUMENTS

| | | | |
|---|---|---|---|
| 3,033,249 | 5/1962 | Tamm | 141/369 |
| 3,211,338 | 10/1965 | Weil et al. | 222/643 |
| 3,244,327 | 4/1966 | Dunning | 222/643 |
| 3,299,656 | 1/1967 | Linstromberg | 62/233 |
| 3,305,133 | 2/1967 | Parker | 222/643 |
| 3,341,065 | 9/1967 | Schuldt et al. | 222/1 |
| 3,437,244 | 4/1969 | Alvarez et al. | 222/240 |
| 3,537,618 | 11/1970 | Alvarez | 222/333 |
| 3,798,923 | 3/1974 | Pink et al. | 62/266 |
| 3,874,559 | 4/1975 | Pink | 222/146 C |
| 3,918,266 | 11/1975 | Gindy et al. | 62/137 |
| 4,040,457 | 8/1977 | Niese et al. | 141/361 |
| 4,084,725 | 4/1978 | Buchser | 221/75 |
| 4,102,660 | 7/1978 | Beckett et al. | 62/344 |
| 4,176,527 | 12/1979 | Linstromberg et al. | 62/320 |

*Primary Examiner*—Michael S. Huppert

*Attorney, Agent, or Firm*—Wood, Phillips, Mason, Recktenwald & Vansanten

[57] ABSTRACT

A method and apparatus for selectively dispensing discrete quantities of elongated ice pieces from a supply thereof. The apparatus includes a baffle defining an upper edge and mechanism adjacent the baffle for causing ice pieces received from the supply to extend lengthwise generally parallel to the baffle and to be translated upwardly to above the level of the baffle upper edge while concurrently tipping the ice pieces over the upper edge to pass to forwardly of the baffle for dispensing thereof. In the illustrated embodiment, the transfer mechanism is defined by at least one helical vane extending from a rearward transfer position to a forward dispensing position defined by the upper edge of the baffle. In the illustrated embodiment, the vanes extend approximately 105° about an axis of rotation thereof within a tubular drum. The apparatus may include a constant speed dispensing mechanism and a timer control for any one of a plurality of preselected time periods. Each time period is preselected to provide a preselected amount of ice bodies from the dispenser. The control further provides dynamic braking of the transfer mechanism motor, and an actuator for automatically initiating operation of a dispensing cycle.

35 Claims, 5 Drawing Sheets

FIG. 6
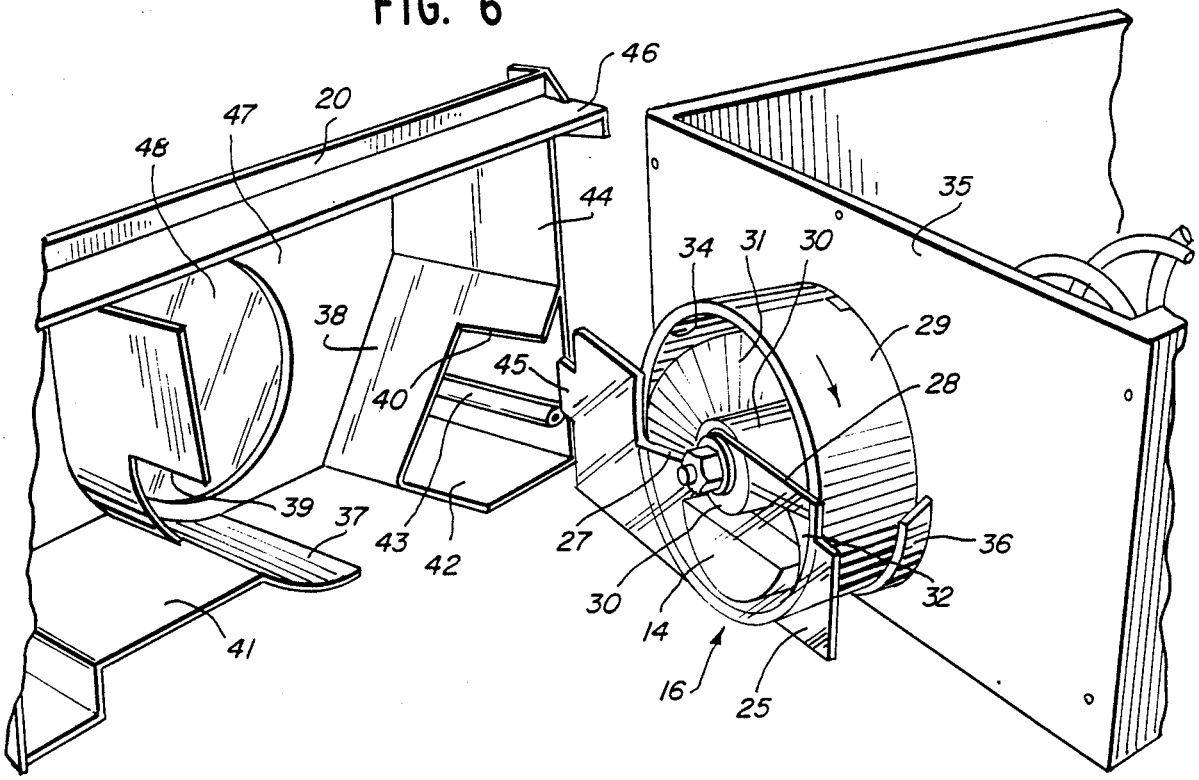
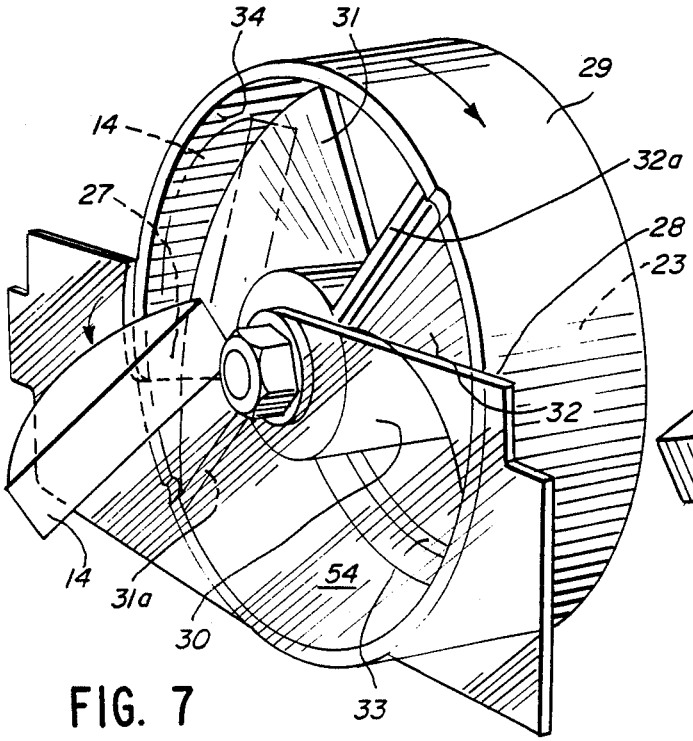
FIG. 7
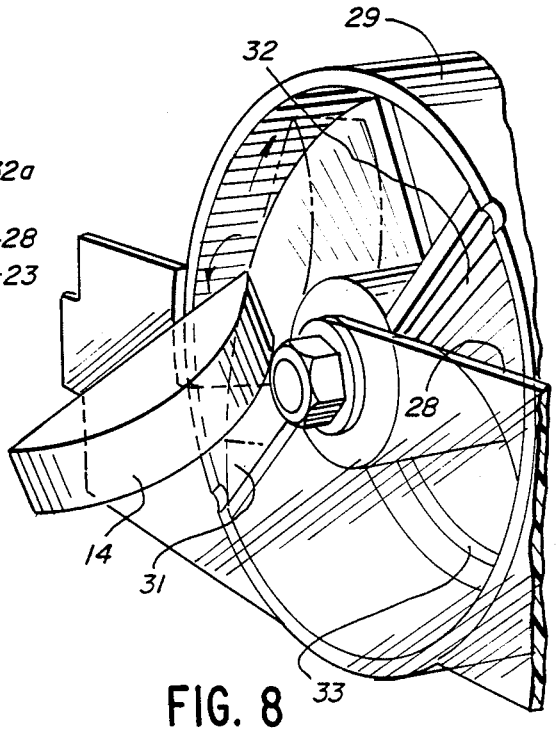
FIG. 8

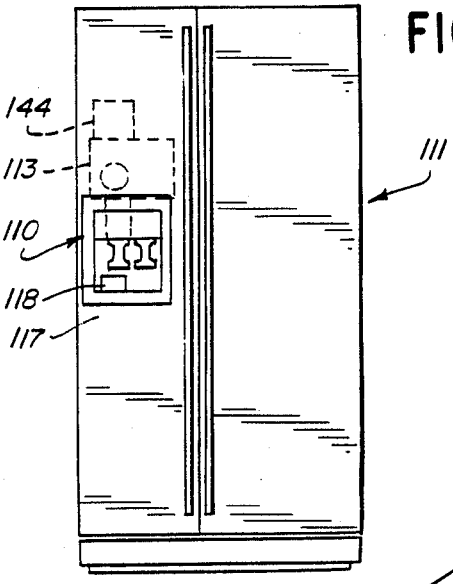
FIG. 9
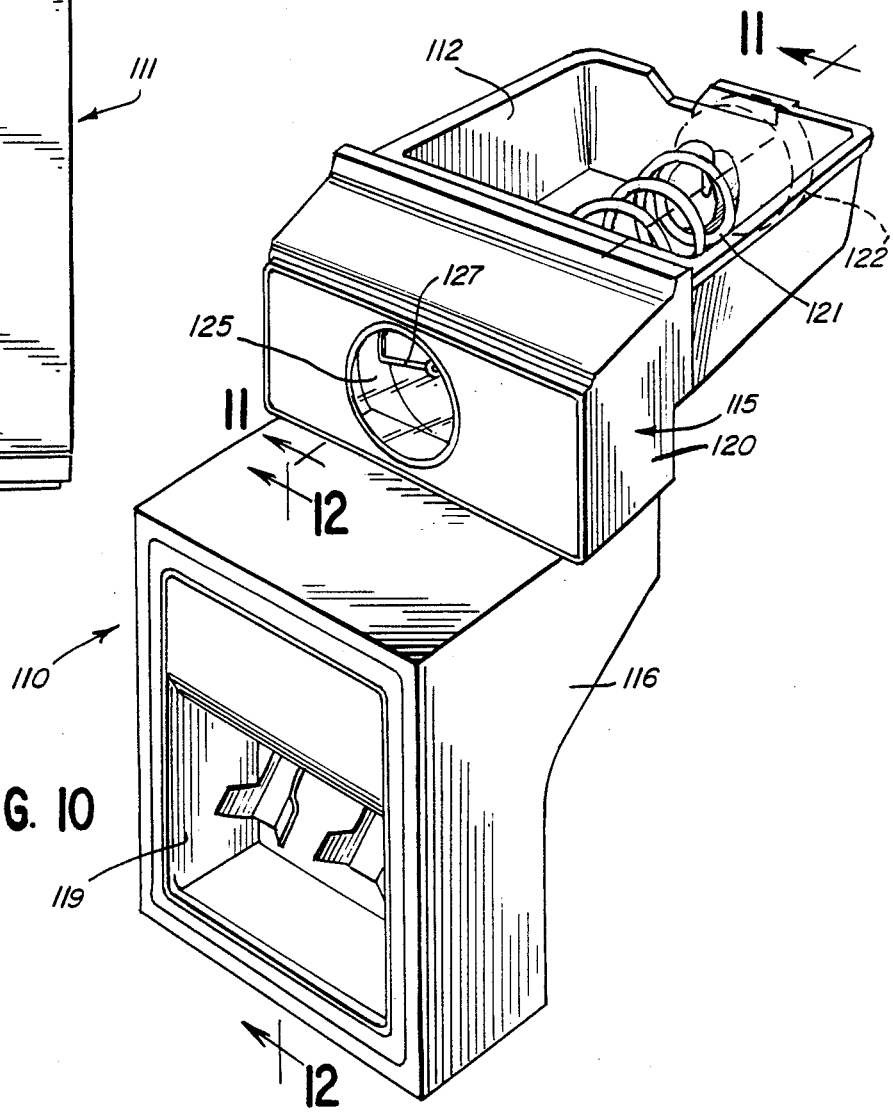
FIG. 10
FIG. 11
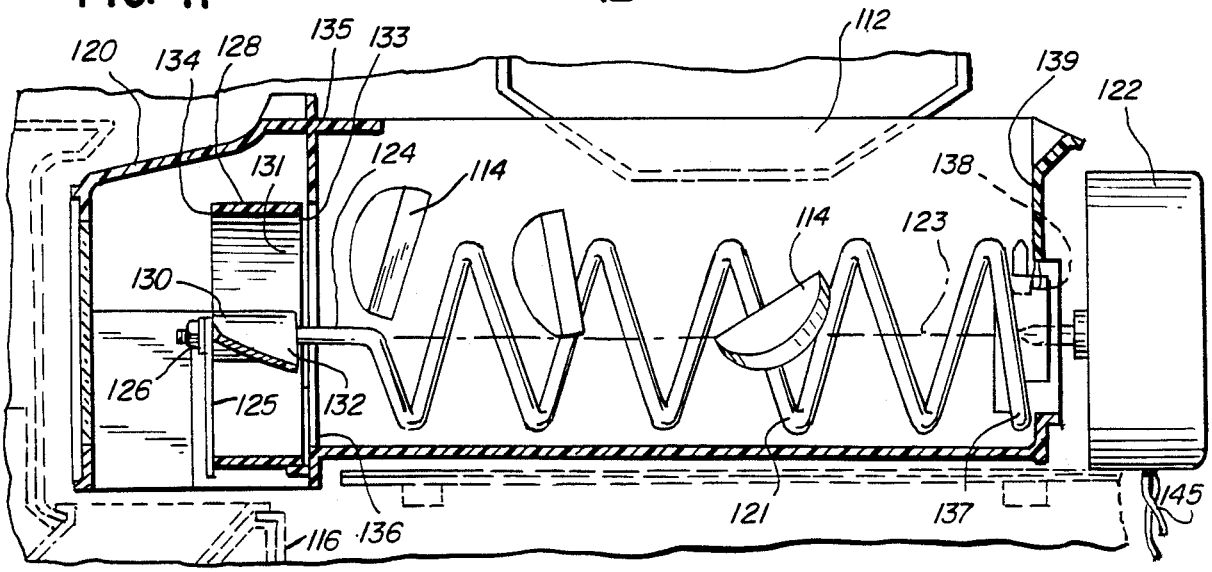

ICE DISPENSING APPARATUS

BACKGROUND OF THE INVENTION

Cross-Reference to Related Applications

This application comprises a continuation-in-part of the copending application Ser. No. 500,324, of William J. Linstromberg, filed June 2, 1983, and entitled "Ice Dispensing Apparatus", now abandoned..

FIELD OF THE INVENTION

This invention relates to ice dispensing apparatus for use in a refrigeration apparatus, such as a refrigerator-freezer, and in particular to apparatus for dispensing of ice pieces at a uniform rate.

BACKGROUND ART

An example of an ice maker apparatus for forming ice pieces and delivering them to a storage receptacle is illustrated in Letters U S. Pat. No. 3,299,656 of William J. Linstromberg et al., which patent is owned by the assignee hereof. As shown therein, an ice mold is provided wherein crescent-shaped ice pieces are formed. These ice pieces are elongated, in that they have a length which is substantially greater than their height or width.

It has been found that a problem arises in dispensing such elongated ice pieces from conventional ice dispensing mechanisms, in that the number of ice pieces dispensed with each operation of the mechanism varies to an undesirable degree. This non-uniform dispensing rate is believed to be due to the fact that elongated ice pieces can enter and be retained in conventional ice dispensing mechanisms in a variety of different orientations, resulting in a wide variation in the number of such ice pieces being transferred and dispensed during each operation of the dispensing mechanism. The present invention is concerned with the problem of transferring such elongated ice pieces from a storage receptacle to a dispensing position in a manner which facilitates dispensing at a uniform rate.

Illustratively, Letters U.S. Pat. No. 4,084,7Z5 of William J. Buchser, which patent is owned by the assignee hereof, discloses an ice dispensing apparatus for use in a domestic refrigerator having an ice maker and an ice storage receptacle. As illustrated, ice cubes are delivered from the storage receptacle to a dispensing position by means of a rotatable tubular drum having an internal helical auger blade. The length of the drum is substantially greater than the length of the ice piece to be dispensed, and metering means is provided at the inlet to the drum.

Another ice dispensing apparatus is illustrated in Letters U.S. Pat. No. 4,176,527 of William J. Linstromberg et al., which patent is also owned by the assignee hereof. As illustrated therein, ice cubes are delivered by a transfer means from the storage receptacle to an ice dispensing position either in the form of crushed ice or integral whole ice cubes. As shown in that patent, the transfer means comprises a rotatable auger blade disposed within a tubular drum opening to the ice storage receptacle and having a length which is greater than the length of the ice piece to be dispensed.

Another form of ice dispenser is illustrated in Letters U.S. Pat. No. 3,437,244 of Robert J. Alvarez et al. As disclosed therein, the dispenser includes a rotatable dispensing drum within the ice storage receptacle. The dispensing means includes a metering section adapted to dispense a predetermined number of ice cubes and includes means for scooping ice cubes from the receptacle and storing the ice cubes at a rate in excess of that at which the ice cubes are dispensed.

Thus, as shown, the transfer means may be selectively disposed within the storage receptacle or adjacent thereto as desired.

SUMMARY OF THE INVENTION

The present invention comprehends an improved ice dispenser advantageously adapted for dispensing elongated ice pieces. Thus, illustratively, the present invention is advantageously adapted for dispensing crescent-shaped ice pieces such as those formed in ice makers of the type illustrated in the Linstromberg et al. U.S. Pat. No. 3,299,656 discussed above. The present invention is, however, also adapted for dispensing generally rectangular elongated ice pieces such as those produced by ice makers of the type illustrated in Letters U.S. Pat. No. 3,677,030 of Duane C. Nichols, which is assigned to the assignee hereof.

The ice dispenser of the present invention provides controlled dispensing of such elongated ice pieces at a uniform rate whenever the ice dispenser is operated.

More specifically, the ice dispensing apparatus of the present invention is adapted for selectively transferring discrete, uniform quantities of elongated ice pieces from a storage receptacle defining an ice transfer position to an ice dispensing position which is spaced horizontally from the transfer position. The apparatus includes baffle means spaced from the ice transfer position and having a generally horizontal upper edge defining a dispensing position. An ice transfer means is positioned between the transfer position and the baffle means for receiving the ice pieces at the transfer position and advancing them to the dispensing position. The transfer means of the present invention is arranged to orient the received ice pieces so that they extend lengthwise generally parallel to the baffle means while concurrently translating them to a generally upright position by the time they have reached the dispensing position.

Resultingly, during a given operation of the ice dispenser, a relatively uniform number of ice pieces enter the ice transfer means and are urged thereby to fall freely and rapidly over the baffle edge in effecting a dispensing operation.

More specifically, the invention comprehends the provision of such an ice dispensing apparatus for selectively dispensing uniform quantities of elongated ice pieces from a supply thereof, including baffle means defining an upper edge and means adjacent the baffle means for causing ice pieces received from the supply to extend lengthwise generally parallel to the baffle means and to be translated upwardly to above the level of the baffle means upper edge while concurrently tipping the ice pieces over the upper edge to pass to forwardly of the baffle means for dispensing thereof.

In the illustrated embodiment, the transfer means is defined by a tubular drum oriented generally horizontally and having an axial length preselected to be less than the length of the elongated ice pieces, or bodies, to be dispensed. The drum defines a transfer chamber, a rear portion opening to the transfer position for receiving the ice pieces in a lower portion of the transfer chamber, and a front portion. Baffle means are mounted adjacent the drum front portion extending across the lower portion of the transfer chamber and defining an upper edge extending transversely across the transfer chamber. The transfer means orients the ice pieces received in the transfer chamber lower portion generally chordally of the drum axis and translates them about the drum axis to a position above the level of the baffle means upper edge while concurrently tipping them over the upper edge to pass forwardly of the drum for dispensing disposition thereof.

In the illustrated embodiment, the baffle means upper edge extends generally horizontally and radially of the drum axis In the illustrated embodiment, the drum defines at least two transfer members at angularly spaced positions about the drum axis.

In the illustrated embodiment, each transfer member comprises a segmentally helical vane having an angular extent about the drum axis of less than 180°.

In the illustrated embodiment, the drum includes a generally cylindrical hub extending along the longitudinal axis of the drum and having a diameter selected such that the radial distance from the hub to the inner surface of the drum is less than the length of the ice pieces.

In the illustrated embodiment, the vane subtends an angle of approximately 105° about the drum axis and is rotatable with the hub. As illustrated, a pair of such vanes may be provided, each vane extending diametrically oppositely from the hub.

In the illustrated embodiment, the baffle wall extends generally across the lower half of the cylindrical drum outlet end.

The invention further comprehends the novel method of dispensing elongated ice pieces from a chamber having an outlet defined by a generally upright baffle defining an upper edge wherein the ice pieces are oriented to extend lengthwise upwardly adjacent the upper edge and urged to tip over the upper edge in being transferred from the chamber.

The ice dispenser of the present invention further includes means for providing preselected quantities of ice pieces in batches at a predetermined rate and means for timing the delivery cycle so as to provide a corresponding number of batches and total number of ice bodies.

The invention comprehends providing either a single batch or whole number multiples of the single batch to the receptacle as selected by the user.

The invention further comprehends the initiation of the timing cycle as an incident of the receptacle being placed at a discharge position.

The invention comprehends the provision of control means associated with the dispenser causing termination of the dispensing operation automatically as a result of removal of the receptacle from the discharge position.

The invention comprehends providing braking means for positively stopping the ice transfer means of the dispenser at the end of the timed cycle.

The timed cycle may comprise any one of a plurality of different time periods comprising whole number multiples of a minimum time period, such as 1½ seconds, corresponding to the delivery of a single batch of ice pieces from the dispenser. Thus, illustratively, where two batches of ice pieces are desired, the user selects a 3-second time delivery, and so forth.

The ice dispensing method and apparatus of the present invention are extremely simple and reliable, while yet providing highly improved selective dispensing of uniform quantities of elongated ice pieces from a storage receptacle.

BRIEF DESCRIPTION OF THE DRAWINGS

Other features and advantages of the invention will be apparent from the following description taken in connection with the accompanying drawings wherein:

FIG. 6 is a fragmentary enlarged perspective view illustrating the ice dispensing apparatus in greater detail, with portions thereof shown in an exploded, angularly related position;

FIG. 7 is a fragmentary enlarged perspective view of the ice transfer means illustrating the tipping of an elongated ice piece over the baffle wall upper edge in effecting the desired transfer;

FIG. 8 is a fragmentary perspective view similar to that of FIG. 7 but illustrating the transfer of the ice piece effected from a reversely oriented disposition of the ice piece in the ice transfer drum;

FIG. 9 is a front view of a refrigeration apparatus having another form of ice dispensing apparatus embodying the invention;

FIG. 10 is a perspective view illustrating the ice dispensing apparatus of FIG. 9;

FIG. 11 is a fragmentary enlarged longitudinal section of the ice dispensing apparatus taken substantially along the line 11—11 of FIG. 10;

DESCRIPTION OF THE PREFERRED EMBODIMENT

Figure 2:
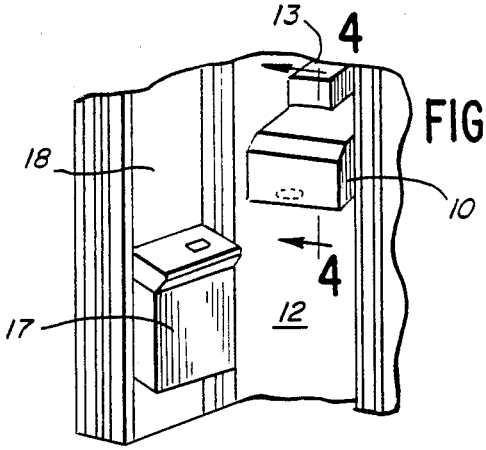
FIG. 2 is a fragmentary perspective view illustrating the disposition of the ice dispensing apparatus within the refrigeration apparatus freezer compartment and showing the relationship thereof with a door-mounted dispensing chute structure.

In the illustrative embodiment of the invention as disclosed in the drawings, an ice dispensing apparatus generally designated 10 is shown to be mounted in a refrigeration apparatus 11 illustratively comprising a side-by-side refrigerator-freezer. As shown in FIG. 2, the ice dispensing apparatus 10 is disposed within the freezer compartment 12 subjacent a conventional ice maker 13, illustratively of the type shown in Letters U.S. Patent 3,299,656.

Figure 1:
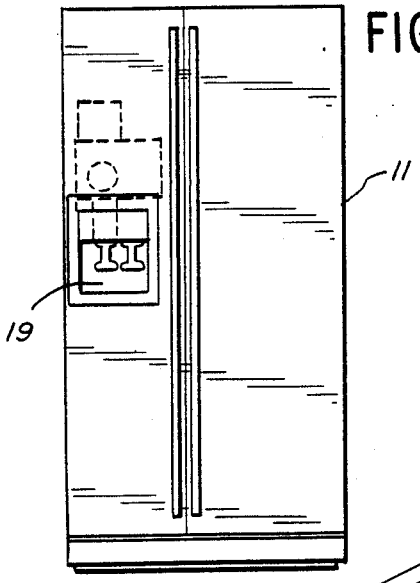
FIG. 1 is a front view of a refrigeration apparatus having an ice dispensing apparatus embodying the invention.
Figure 4:
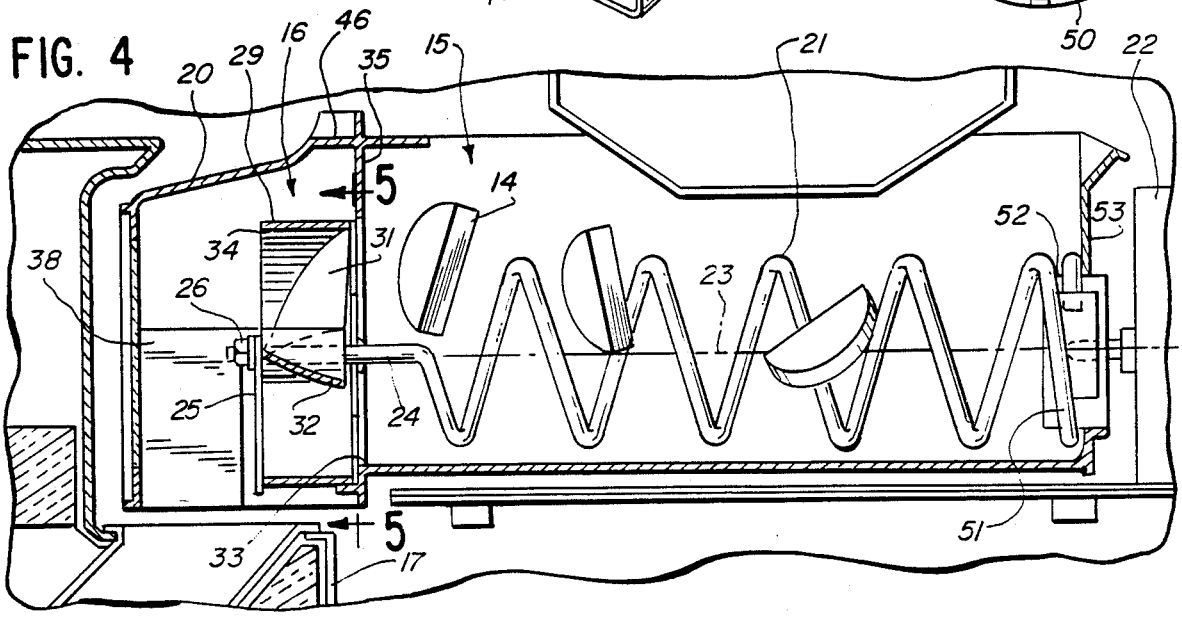
FIG. 4 is a fragmentary enlarged longitudinal section of the ice dispensing apparatus.

Elongated ice pieces, such as crescent-shaped ice pieces 14 illustrated in FIG. 4, are formed by the ice maker 13 and delivered downwardly therefrom into a rear, upwardly opening storage receptacle 15. By way of example, the crescent-shaped ice pieces may have a length of 2¾ inches, a height of 1 inch and a width of ⅞ inch. In the illustrated embodiment, the ice pieces are transferred by an improved transfer means 16 from receptacle 15 to a discharge chute 17 carried on the door 18 of the freezer compartment, whereby the ice pieces may be dispensed through a conventional forwardly exposed ice dispenser station 19 (see FIG. 1).

Figure 3:
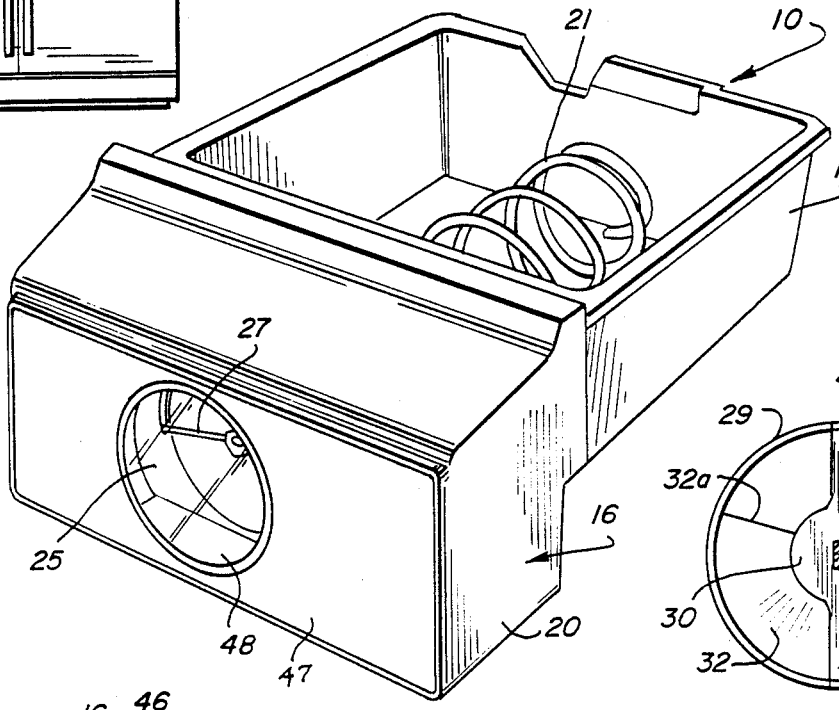
FIG. 3 is a perspective view illustrating the ice dispensing apparatus.

As illustrated in FIGS. 3 and 4, transfer means 16 is disposed in a suitable housing 20 at the front end of receptacle 15 and the housing illustratively say comprise an extension of the receptacle 15.

Ice pieces are moved from the receptacle to the transfer means by means of a helical rod 21 defining an auger-type conveyor, which is driven in the conventional manner by a rear drive motor 22 to rotate about a generally horizontal axis 23. The front end 24 of rod 21 extends axially through a front wall or baffle, 25. A suitable nut and bearing assembly 26 is threaded to the distal end of rod end portion 24 for rotatably coupling the rod end 24 to the baffle.

Baffle 25 defines a first edge 27 extending radially and generally horizontally of axis 23. As best seen in FIG. 6, edge 27 follows a radius which is angled slightly downwardly from the horizontal. The baffle wall further defines a second edge 28 extending generally diametrically oppositely of edge 27. More specifically, edge 28, as shown in FIG. 7, extends horizontally at a level slightly above that of edge 27.

Transfer means 16 includes a tubular drum 29 mounted to a coaxial hub 30 by one or more vanes. In the illustrated embodiment, a pair of vanes 31 and 32 i: provided. The hub 30 is secured to rod portion 24 by suitable conventional fastening means.

Each of the vanes is helical and extends forwardly from a drum inlet opening 33 to the forward outlet opening 34 of the drum. Inlet opening 33 is provided in the front wall 35 of the storage receptacle through which the ice pieces 14 are delivered by the rotating helical rod 21, as illustrated in FIG. 4.

Figure 5:
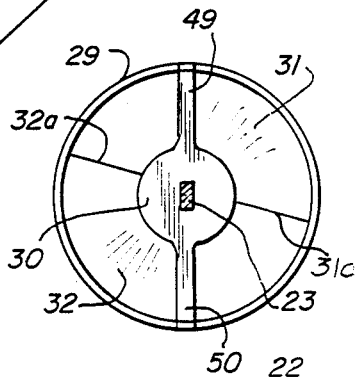
FIG. 5 is a fragmentary transverse section taken substantially along the line 5—5 of FIG. 4.

As can be seen with reference to FIGS. 4 and 5, the rear, or inlet, portion of the drum 29 defines a generally open inlet area for permitting substantially unrestricted entry of ice pieces into the drum 29 from the receptacle 15. The number of ice pieces entering and being transferred by the drum is thus determined primarily by the dimensions of the drum and the orientation which the ice pieces assume within the drum.

As seen in FIG. 6, drum 29 is partially surrounded by an arcuate support wall 36 projecting forwardly from wall 35. Ice pieces 14 entering the rear of the drum 29 are urged forwardly and into a generally upright disposition by the vane as its forward edge portion, 31*a* or 32*a*, moves from the 3 o'clock to the 9 o'clock position. As the forward edge portion of the vane approaches the 9 o'clock position, the helical configuration of the vane causes the ice piece to move forwardly so as to tip over the baffle edge 27, as illustrated in FIG. 7, and thereby be dispensed from the drum.

Housing 20, as illustrated in FIG. 6, is provided internally with a pair of guide walls 37 and 38 which direct the ice piece after it has been tipped over the baffle edge 27 downwardly to the chute structure 17. The guide walls further define retaining shoulders 39 and 40 cooperating with platform walls 41 and 42, respectively, for retaining the baffle 25 therebetween. In addition, a retaining rib 43 is provided on the left sidewall 44 of the housing 20 for cooperation with shoulder 40 in engaging a tab 45 on the baffle wall.

The above described retaining means and the baffle 25 are dimensioned so as to permit a small amount of lateral and vertical movement of the baffle within the housing portion 20. This permits similar movement of the rod end 24 and, hence, the transfer means 16, during operation of the dispensing apparatus, and such movement has been found to facilitate reliable and uniform dispensing of the ice pieces.

Housing 20 is provided with a rearwardly extending canopy 46 which, as shown in FIG. 4, overlies the receptacle 15 in the assembled arrangement of the apparatus.

Front wall 47 of the housing may be provided with a window 48.

As seen in FIG. 5, vanes 31 and 32 subtend an angle of approximately 105° about the axis of rotation 23 and have substantially diametrically opposed rear edge portions 49 and 50, respectively.

In the illustrated embodiment, the rear end portion 51 of the helical rod 21 is secured to a cylindrical mounting element 52 which is rotatably journaled in the rear wall 53 of the storage receptacle and, in turn, driven by the motor 22 about axis 23.

When desired, the transfer structure may be readily removed from the apparatus by firstly removing the housing 20 and then withdrawing the transfer means and helical rod 21 through the front opening 33 of the receptacle wall 35.

Thus, the invention comprehends an improved ice dispensing apparatus 10 for selectively dispensing discrete, uniform quantities of elongated ice pieces, or bodies, 14 f om an ice storage receptacle 15 defining an ice transfer position which, in the illustrated embodiment, comprises an opening 33 in the receptacle front wall 35. Means 21 are provided for urging the ice pieces in the receptacle generally horizontally toward the transfer position and into the lower portion of a rotating drum 29 forwardly of opening 33.

Baffle means in the form of a will 25 is provided adjacent the transfer position, and in the illustrated embodiment, at the front end of the drum 29. The baffle wall has a generally horizontal upper edge which defines a dispensing position.

Ice transfer means having one or more vanes, such as vanes 31 and 32, is positioned between the transfer position 33 and the dispensing position for receiving ice pieces at the transfer position and advancing them to the dispensing position. The transfer means orients the received ice pieces so that their length extends generally parallel to the baffle. The transfer means further translates the received ice pieces to a generally upright position before they are delivered to the dispensing position, whereby they may fail freely and rapidly over the baffle edge 27.

In the illustrated embodiment, the ice pieces are tipped by the vanes over the edge 27 and due to the generally upright orientation of the ice pieces as they approach edge 27, rapid and complete discharge of all the ice pieces contained within each respective section of the transfer means is facilitated.

In the illustrated embodiment of FIGS. 1–7, the desired orientation of the ice pieces within the tubular drum 29 is achieved by a particular dimensioning of the drum in relation to the length of the elongated ice pieces. Thus, the axial length of the drum is selected to e less than the length of the elongated ice pieces to be dispensed. This prevents the ice pieces from becoming oriented lengthwise in the drum, and tends to force the ice pieces toward the desired orientation in which they are generally parallel to the baffle.

Also as illustrated, the radial distance between the hub 30 and drum 29 is selected to be less than the length of the elongated ice pieces to be dispensed. In particular, as best seen in FIGS. 7 and 8, the hub has a relatively large diameter. This dimensioning of the hub and drum causes the ice pieces to assume a generally chordal orientation, as opposed to a radial orientation, once they have entered the drum 29. Such a chordal orientation of the ice pieces, as also illustrated in FIGS. 7 and 8, results in the ice pieces tending to assume the desired generally upright orientation as they arrive at the dispensing position defined by baffle edge 27.

The helical vanes 31 and 32, as previously described, cause the ice pieces to move through the drum 29 to the dispensing position as the drum is rotated.

The above described transfer means has been found to provide improved uniformity in the rate at which elongated ice pieces are discharged from the ice dispenser apparatus 10 to the discharge chute 17. The improved uniformity is believed to be primarily due to the particular orientation which the elongated ice pieces are caused to assume as they pass through the transfer means 16.

It will be appreciated that, in broad aspect, the transfer means comprises at least one ramp element and means for moving the ramp element to move and translate the ice pieces.

The invention further broadly comprehends an improved method of dispensing elongated ice pieces from an apparatus having an outlet defined by a generally upright baffle 25, including the steps of orienting the ice pieces to extend lengthwise upwardly adjacent an upper edge of the baffle, and urging the ice pieces to tip over the upper edge to be discharged from the apparatus. At least some of the ice pieces will attempt to enter the transfer means with their elongated extent transverse to the baffle, and the novel method comprehends reorienting the ice pieces so as to be generally parallel thereto prior to the urging of the ice pieces to tip over the baffle edge.

In the embodiment of FIGS. 9–14, the ice pieces are similarly delivered in batches from the dispensing drum with substantially the same number of ice pieces being dispensed from each of the two spaces between the vanes 131 and 132 seriatim as the drum is rotated about axis 123. The motor 122 comprises an essentially constant speed motor whereby the delivery of the successive batches of the ice pieces from the drum 128 may be effected at a constant rate. Illustratively, the motor may be operated at a suitable speed preselected to dispense the ice pieces from the respective spaces between vanes 131 and 132, i.e. every one-half rotation of the drum, every 1½ seconds.

Figure 12:
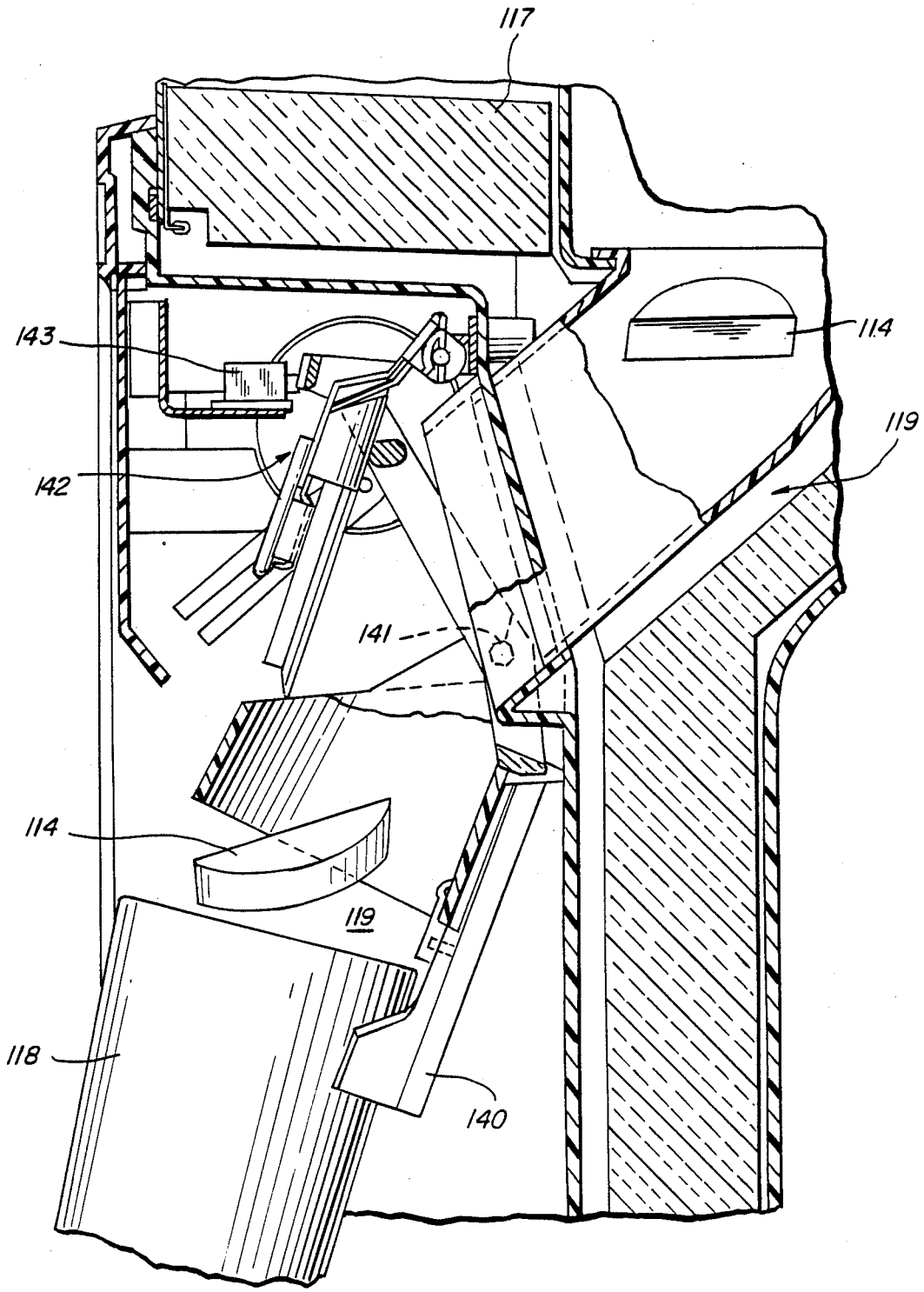
FIG. 12 is a fragmentary vertical section taken substantially along the line 12—12 of FIG. 10.

As seen in FIG. 12, when cup 118 is urged against an actuating lever 140 pivotally mounted to the mechanism on a pivot 141, an extension of the actuating lever generally designated 142 actuates an ice dispenser switch 143 electrically connected to a timer control 144, as shown in FIG. 10. The timer control, in turn, is connected to the timer mo&or 122, as shown in FIG. 11, through suitable connecting leads 145.

As discussed above, the control is arranged to cause operation of the constant speed drive motor 122 for any one of a preselected number of preselected time intervals, such as 1½ seconds. Resultingly, any one of a number of batches of ice bodies may be delivered from the respective compartments defined by the vanes and tubular wall so that an accurately determinable amount of ice bodies may be dispensed as a result of the energization of the control by operation of switch 143.

Figure 13:
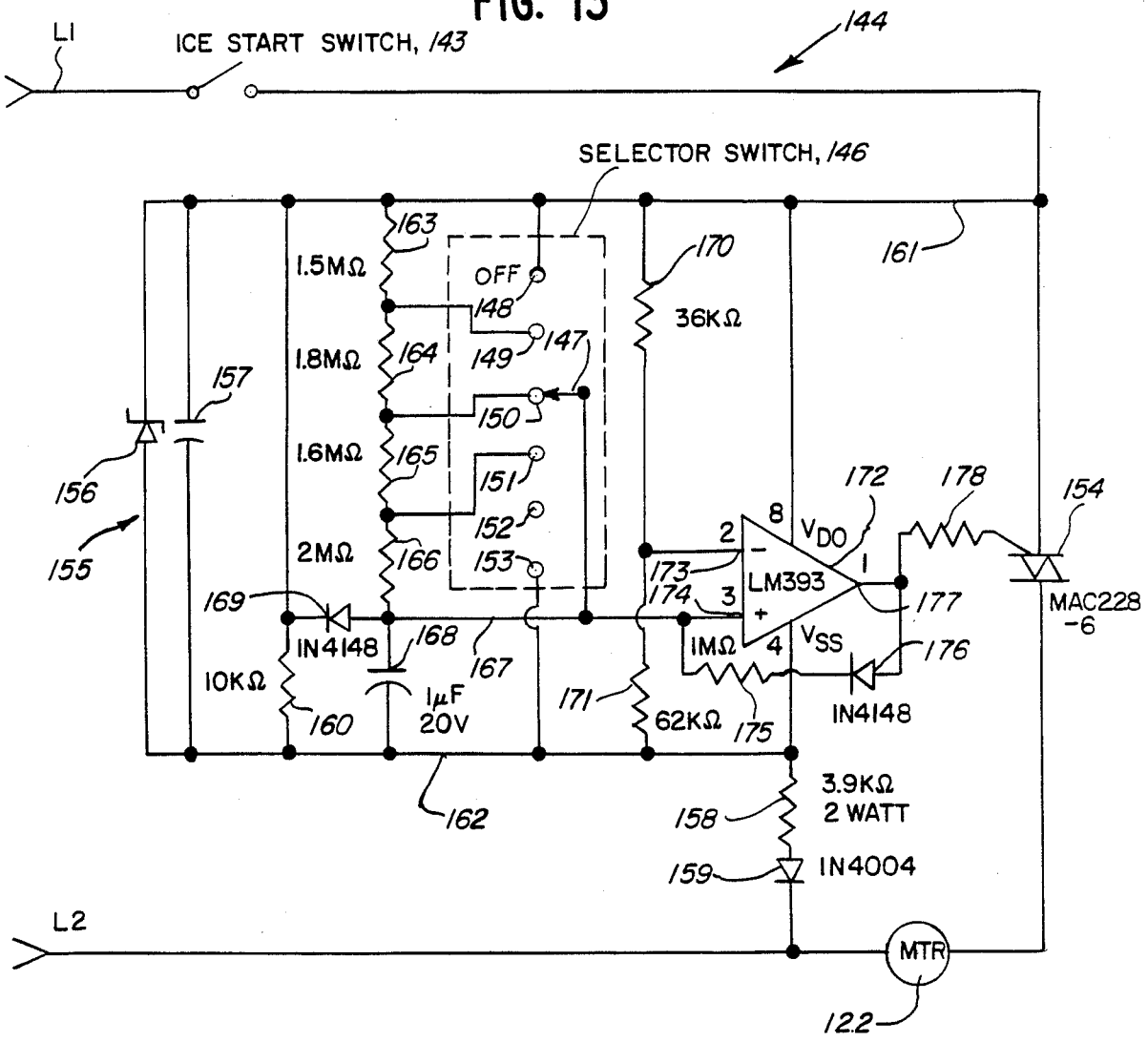
FIG. 13 is a schematic wiring diagram of the metering control means of the invention.

An exemplary control circuit is illustrated in FIG. 13. As shown therein, the control 144 includes a selector switch 146, permitting the user to select any one of a plurality of different number of batches of ice bodes to be dispensed automatically by the ice dispenser 110. The selector switch includes a movable contact 147, which may be selectively engaged with any one of a plurality of fixed contacts 148, 149, 150, 151, 152, or 153.

Switch 143 comprises a normally open, single pole, single throw switch connected to power supply lead L1. The switch, in turn, is connected through a gated electronic switch 154 and motor 122 to the opposite power supply lead L2. Switch 154 may comprise a conventional triac.

The power supply portion of the circuit generally designated 155 includes a 24-volt zener diode 156, a 20 microfarad 35-volt capacitor 157, a 3.9 kilohm 2-watt resistor 158, and a diode 159. Zener diode 156, capacitor 151, and 10 kilohm resistor 160 are connected in parallel between a lead 161 connected to between switch 143 and triac 154, and a lead 162 connected to resistor 158. A 1.5 megohm resistor 163 is connected from lead 161 in series with a 1.8 megohm resistor 164, in turn connected in series with a 1.6 megohm resistor 165, in turn connected in series with a 2 megohm resistor 166 to a lead 167 connected through a 1 microfarad 20-volt capacitor 168 to lead 162. A diode 169 is connected between lead 167 and lead 161 in parallel with the series-connected resistors 163, 164, 165 and 166.

Fixed contact 148 of selector switch 146 is connected to lead 161. Fixed contact 149 is connected to between resistors 163 and 164. Fixed contact 150 is connected to between resistors 164 and 165. Fixed contact 151 is connected to between resistors 165 and 166. Fixed contact 153 is connected to lead 162. Moving contact 147 is connected to lead 167.

A 36-kilohm resistor 170 is connected in series with a 62-kilohm resistor 171 between leads 161 and 162.

A voltage comparator 172 has its negative input 173 connected to between resistors 170 and 172 and its positive input 174 connected to lead 167.

A 1-megohm feedback resistor 175 is connected in series with a diode 176 across the positive input 174 to the output 177 of the comparator 172. Output 177, in turn, is connected through a gate current limiting resistor 178 to the gate of triac 154.

Diode 176 acts to prevent resistor 175 from acting as a voltage divider with the resistors 163, 164, 165 and 166. Feedback resistor 175 may be zero ohms. However, the 1 megohm resistor used as resistor 175 provides hysteresis in the operation comparator 172 to provide a period dynamic braking of the motor 122 in the operation of the dispenser so as to provide improved accuracy in the dispensing operation.

Diode 169 and resistor 160 act as a discharge means for capacitor 168.

In the operation of the control, variable time of operation of motor 122 is generated by the RC time constant of the selected resistances depending on the setting of movable contact 147, and the capacitor 168.

The indicated power supply has a substantial ripple in going from Vmin. to Vmax. When the voltage on capacitor 168 is below Vmin., such as during the dispensing operation, the motor receives full wave power from the triac. When the voltage on capacitor 168 is between Vmin. and Vmax. at the end of the dispensing time, the motor receives ½ wave power so as to give a braking action. When the voltage on capacitor 168 is greater than Vmax., the motor is effectively disconnected.

The use of the 1 megohm feedback resistor 175 provides a braking period which is several line cycles long.

Figure 14:
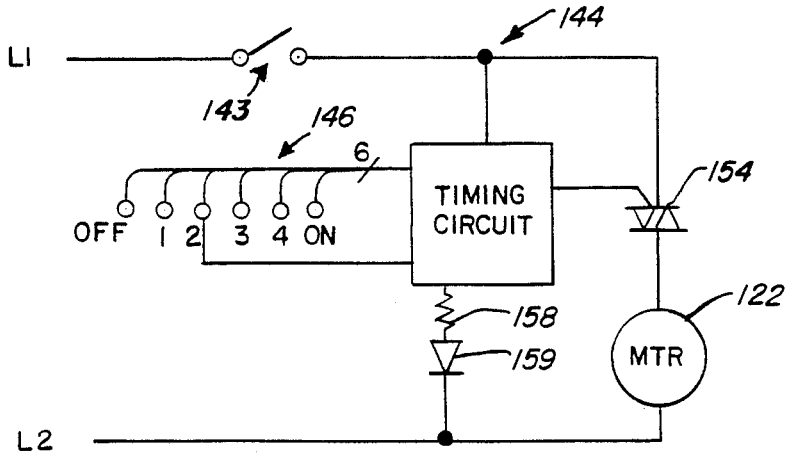
FIG. 14 is a schematic diagram broadly illustrating the control arrangement.

When switch 143 is opened prior to completion of the timing out of the control, the dynamic braking action is prevented because the voltage on capacitor 168 is below Vmin. The overall arrangement of the control 144 is schematically illustrated in FIG. 14.

The illustrated control may be utilized with a conventional 20 rpm dispenser motor to provide the desired 1½-second timing for each one-half revolution of the ice dispenser drum. The selector switch 146 permits the drive motor to provide one-half, one, one and a half, or two revolutions of the ice dispensing drum as a result of energization of :he control by the closing of switch 143 automatically by the engagement of the cup or container 18 with the actuator 140. By connecting the movable contact 147 to the fixed contact 148, the control may be disabled so as to be in a permanently "off" condition. Alternatively, by connecting the movable contact 147 to the fixed contact 153, the control may be arranged to continuously provide ice. The use of an RC timing circuit with the voltage comparator provides a control responding to the capacitor voltage threshold. The DC voltage is provided by a conventional transformerless power supply, which permits a supply ripple to purposely occur and be reflected into the comparator 172.

Performance tests utilizing control 144 have indicated a high reliability in the provision of desired numbers of ice bodies at the different settings of the selector switch. The timing circuit has been found to be extremely reliable in providing an accurate dispensing of preselected quantities of ice bodies under the control of the selector switch with automatic dispensing effected by means of the actuator element 140.

Thus, the invention provides improved means for selectively causing an initiated operation of an ice body transfer means to continue only for any one of a plurality of different accurately preselected time periods for transferring any one of a plurality of correspondingly accurate quantities of ice bodies by means of a constant speed dispensing motor. The initiation of the operation of the transfer means may be effected by placement of an ice body receiver at a discharge position.

The invention utilizes a rotary transfer means which is rotated a preselected amount in each of the accurately preselected time periods.

The invention provides simple braking means for braking the ice dispenser motor at the end of the preselected time periods to provide maximized accuracy in the dispensing operation. The braking means may comprise dynamic braking means provided by the control circuit.

The control provides timer means for selectively operating the transfer means and, in the illustrated embodiment, the timer comprises an RC timer and voltage comparator.

The foregoing disclosure of specific embodiments is illustrative of the broad inventive concepts comprehended by the invention.

We claim:

1. In an ice dispensing apparatus for selectively dispensing uniform quantities of elongated ice pieces from an ice storage receptacle defining an ice transfer position and means for urging the ice pieces in the receptacle generally horizontally toward said transfer position, and baffle means spaced from said transfer position, said baffle means having a generally horizontal upper edge which defines a dispensing position, the improvement comprising ice transfer means positioned between said transfer position and said baffle means for receiving ice pieces at said transfer position and advancing said ice pieces to said dispensing position, said ice transfer means comprising means for orienting substantially all of the received elongated ice pieces such that their length extends generally parallel to said baffle means and in a generally upright direction at said dispensing position, whereby said ice pieces are caused to fall freely and rapidly over said baffle edge.

2. The ice dispensing apparatus of claim 1 wherein said transfer means comprises at least ore ramp element and means for moving the ramp element to translate ice pieces delivered into association therewith from said transfer position.

3. The ice dispensing apparatus of claim 1 wherein said transfer means comprises at least one helical vane and means for moving the helical vane to translate ice pieces delivered into association therewith from said transfer position.

4. In an ice dispensing apparatus for selectively dispensing uniform quantities of elongated ice pieces from an ice storage receptacle defining an ice transfer position and means for urging the ice pieces in the receptacle generally horizontally toward said transfer position, the improvement comprising:

baffle means spaced from said transfer position, said baffle means having a generally horizontal upper edge which defines a dispensing position; and ice transfer means positioned between said transfer position and said baffle means for receiving ice pieces at said transfer position and advancing said ice pieces to said dispensing position, said transfer means orienting the received ice pieces such that their length extends generally parallel to said baffle means and translating said received ice pieces to be generally upright position before being delivered to said dispensing position, whereby said ice pieces are caused to fall freely and rapidly over said baffle edge, said transfer means comprising a plurality of helical vanes carried on a cylindrical hub and means for rotating the hub about about an axis of rotation, the cumulative angular extent of the vanes being less than 360°.

5. In an ice dispensing apparatus for selectively dispensing uniform quantities of elongated ice pieces from a storage receptacle having means defining a transfer position and means for urging the ice pieces from the receptacle generally horizontally outwardly toward said transfer position, the improvement comprising:

a tubular drum oriented generally horizontally and having an axial length preselected to be less than the length of the elongated ice pieces to be dispensed, said drum defining a rear portion open to said transfer position for receiving the ice pieces therethrough, and a front portion;

baffle means mounted adjacent said drum front portion and extending transversely across the lower portion of said drum and defining an upper edge extending generally horizontally; and a transfer member in said drum fur orienting the ice pieces received in said drum lower portion generally chordally of the drum axis, and translating the ice pieces about the drum axis to a position above the level of said baffle means upper edge while concurrently tipping the ice pieces over said upper edge to pass to forwardly of the drum for dispensing disposition thereof.

6. The ice dispensing apparatus of claim 5 wherein said upper edge extends generally horizontally radially of said drum 7. The ice dispensing apparatus of claim 5 wherein said upper edge extends generally horizontally and said transfer member comprises means for orienting the elongated ice piece in a generally upright position adjacent said baffle upper edge whereby the ice piece is urged to tip lengthwise over said upper edge in being dispensed from the drum.

8. The ice dispensing apparatus of claim 5 wherein said drum includes at least two such transfer members at angular spaced positions about said drum axis.

9. The ice dispensing apparatus of claim 5 wherein said drum includes two such transfer members at angular spaced positions about said drum axis, each transfer means comprising a segmentally helical vane having an angular extent about the drum axis of less than 180°.

10. In a refrigeration apparatus having an ice piece storage receptacle, improved means for dispensing elongated ice pieces from said receptacle at a uniform rate, comprising:

a cylindrical drum defining a generally horizontal longitudinal axis, an inner surface, an inlet end positioned to receive ice pieces from said ice receptacle, and an outlet end, and having an axial length less than the length of said ice pieces;

a generally cylindrical hub extending along the longitudinal axis of said drum and having a diameter such that the radial distance from the hub to said inner surface of said drum is less than the length of said ice pieces;

a vane extending radially outward from said hub toward said drum inner surface, said vane extending along a helical path extending between said drum inlet end and said drum outlet end and substantially an angle of approximately 105° about said axis;

a baffle mounted adjacent said outlet end of the drum and extending across a lower portion thereof to define an ice outlet over which ice pieces are delivered by rotational movement of said vane; and mounting means for mounting said hub for rotational movement about said axis.

11. The refrigeration apparatus of claim 10 wherein said drum is rotatable with said hub.

12. The refrigeration apparatus of claim 10 further including a second vane mounted to said hub and extending diametrically oppositely from said other vane.

13. The refrigeration apparatus, of claim 10 wherein said baffle defines an upper edge, said vane being arranged to tip the ice pieces over said edge as a result of said rotational movement of the hub.

14. The refrigeration apparatus of claim 10 wherein said baffle defines an upper edge extending radially toward said drum axis, said vane being arranged to tip the ice pieces over said edge as a result of said rotational movement of the hub.

15. The refrigeration apparatus of claim 10 wherein said drum inlet end defines a generally open inlet area for permitting the substantially unrestricted entry of said ice pieces into said drum.

16. In a refrigeration apparatus having an ice piece storage receptacle, improved ice dispensing means associated with said receptacle and configured for dispensing at a uniform rate elongated ice pieces, comprising:

a cylindrical drum positioned with its longitudinal axis extending generally horizontally and defining an inner surface, an inlet end positioned to receive ice pieces from said ice receptacle, an outlet end, and having an axial length less than the length of said ice pieces;

a cylindrical hub extending along the longitudinal axis of said drum;

a pair of diametrically opposed helical vanes extending radially outward from said hub toward said drum inner surface, each of said vanes extending between said drum inlet end and said drums outlet end and subtending an angle of less than 180′ about said axis;

means fixedly associating the drum and hub for concurrent rotation about said axis;

a baffle mounted adjacent the lower portion of said outlet end of the drum over which baffle ice pieces are delivered by rotational movement of said associated hub, drum, and vanes; and mounting means mounting said associated hub, drum and vanes for rotation about said axis.

17. The refrigeration apparatus of claim 16 wherein each of said vanes subtend an angle of approximately 105°.

18. The refrigeration apparatus of claim 16 wherein the radial spacing between said hub and drum is less than the length of said elongated ice pieces.

19. The refrigeration apparatus of claim 16 wherein said baffle defines an edge portion over which the ice pieces are tipped extending radially of said drum axis.

20. The refrigeration apparatus of claim 16 wherein said baffle defines a first edge portion over which the ice pieces are tipped extending radially of said drum axis and a second, substantially horizontal, edge portion extending generally oppositely from adjacent the hub.

21. The method of dispensing uniform quantities of elongated ice pieces from a chamber having an outlet defined by a generally upright baffle defining an upper edge, comprising the steps of:

orienting substantially all of the elongated ice pieces to extend lengthwise upwardly adjacent said baffle upper edge; and urging the upwardly extending ice pieces to tip over said upper edge to be transferred from said chamber.

22. The method of dispensing elongated ice pieces of claim 21 wherein said step of urging the ice pieces is effected concurrently with said step of causing the ice pieces to extend adjacent said upper edge.

23. The method of dispensing elongated ice pieces of claim 21 wherein said upper edge defines a rectilinear edge extending at a small angle to the horizontal.

24. The method of dispensing elongated ice pieces of claim 21 wherein at least a portion of said ice pieces are introduced into said chamber in a generally horizontal disposition.

25. The method of dispensing elongated ice pieces of claim 21 wherein at least a portion of the ice pieces are introduced into said chamber with their elongated extent transverse to said baffle.

26. The method of dispensing elongated ice pieces from a refrigeration apparatus having an ice storage receptacle defining an ice transfer position and having a baffle having an edge which defines a dispensing position, comprising the steps of:

receiving said ice pieces at said transfer position in a plurality of lengthwise orientations;

orienting said ice pieces to extend lengthwise generally parallel to said baffle;

translating said ice pieces to a generally upright orientation; and urging said ice pieces over said baffle edge.

27. In an ice dispensing apparatus for selectively dispensing discrete quantities of elongated ice pieces from a supply thereof, the improvement comprising:

wall means defining an upper edge; and means adjacent said wall means for causing substantially all of the elongated ice pieces received from said supply to extend lengthwise generally upwardly parallel to said wall means and to be translated upwardly to above the level of said wall means upper edge while concurrently tipping the ice pieces lengthwise over said upper edge to pass to forwardly of the the wall means for dispensing thereof.

28. The ice dispensing apparatus of claim 1 further including means for causing operation of the ice transfer means only for any one of a plurality of different accurately preselected time periods for transferring any one of a plurality of correspondingly accurate numbers of said ice pieces.

29. The ice dispensing apparatus of claim 4 further including means for causing operation of the ice transfer means only for any one of a plurality of different accurately preselected time periods for transferring any one of a plurality of correspondingly accurate numbers of said ice pieces.

30. The ice dispensing apparatus of claim 5 further including means for causing operation of the ice dispensing apparatus only for any one of a plurality of different accurately preselected time periods for transferring any one of a plurality of correspondingly accurate numbers of said ice pieces.

31. The ice dispensing apparatus of claim 10 further including means for causing operation of the ice dispensing apparatus only for any one of a plurality of different accurately preselected time periods for transferring any one of a plurality of correspondingly accurate numbers of said ice pieces.

32. The ice dispensing apparatus of claim 16 further including means for causing operation of the ice dispensing means only for any one of a plurality of different accurately preselected time periods for transferring any one of a plurality of correspondingly accurate numbers of said ice pieces.

33. The method of dispensing uniform quantities of elongated ice pieces of claim 21 wherein said step of urging the ice pieces is continued only for any one of a plurality of differently accurately preselected time periods.

34. The method of dispensing uniform quantities of elongated ice pieces of claim 26 wherein said step of urging the ice pieces is continued only for any one of a plurality of different accurately preselected time periods.

35. The ice dispensing apparatus of claim 27 further including means for causing operation of the ice dispensing apparatus only for any one of a plurality of different accurately preselected time periods for transferring any one of a plurality of correspondingly accurate number of said ice pieces.

* * * * *